US009254038B2

(12) United States Patent
Molteni

(10) Patent No.: US 9,254,038 B2
(45) Date of Patent: Feb. 9, 2016

(54) EXTRACTABLE DRAWER DEVICE AND FURNITURE ITEM COMPRISING SAID DRAWER DEVICE

(71) Applicant: UNIFOR S.P.A., Turate, Como (IT)

(72) Inventor: Piero Molteni, Como (IT)

(73) Assignee: UNIFOR S.P.A. (IT)

( * ) Notice: Subject to any disclaimer, the term of this patent is extended or adjusted under 35 U.S.C. 154(b) by 0 days.

(21) Appl. No.: 14/549,859

(22) Filed: Nov. 21, 2014

(65) Prior Publication Data

US 2015/0144035 A1 May 28, 2015

(30) Foreign Application Priority Data

Nov. 28, 2013 (IT) ..... MI2013A1990

(51) Int. Cl.
*A47B 95/00* (2006.01)
*A47B 88/04* (2006.01)

(52) U.S. Cl.
CPC ..... *A47B 88/04* (2013.01); *A47B 88/0407* (2013.01)

(58) Field of Classification Search
CPC ..... A47B 88/04; A47B 21/00; A47B 21/03
USPC ..... 108/50.01, 50.02, 143; 312/330.1, 333, 312/334.1, 223.3
See application file for complete search history.

(56) References Cited

U.S. PATENT DOCUMENTS 5,287,815 A * 2/1994 Gross ..... 108/50.14
5,302,015 A * 4/1994 Du Vall ..... 312/323
5,620,228 A * 4/1997 Ito et al. ..... 312/333
5,895,020 A * 4/1999 Danzyger et al. ..... 248/918
6,099,094 A * 8/2000 Lior ..... 108/50.01
6,474,760 B2 * 11/2002 Rauls ..... 312/330.1
7,780,254 B2 * 8/2010 Wang et al. ..... 312/333
2002/0158556 A1 * 10/2002 Cheng ..... 312/333
2003/0042380 A1 * 3/2003 Hagglund et al. ..... 108/50.01
2010/0066224 A1 * 3/2010 Placke et al. ..... 312/333
2010/0277047 A1 11/2010 Sung
2011/0080081 A1 * 4/2011 Klausing et al. ..... 312/333
2014/0145577 A1 * 5/2014 Zimmermann ..... 312/333

FOREIGN PATENT DOCUMENTS

DE 19502526 2/1996
EP 0421275 10/1991

OTHER PUBLICATIONS

European Search Report; Jul. 31, 2014; The Hague; Application IT MI20131990; 7 pages.

* cited by examiner

*Primary Examiner* — Jose V Chen
(74) *Attorney, Agent, or Firm* — Thomas Horstemeyer LLP

(57) ABSTRACT

Extractable drawer device (1), comprising: a drawer (10) having a front end (15) and a rear end (14) with respect to an extraction direction of the drawer in a sliding direction (S-S); a guide and support system of the drawer (10) connectable to a piece of furniture and configured to permit a displacement of the drawer (10) between a retracted drawer position and an extracted drawer position, wherein, in the extracted drawer position, the drawer (10) is completely outside and distant from the space occupied in the retracted position. Piece of furniture with a top (100) having a visible edge (101), comprising said extractable drawer device (1), wherein said drawer device (1) is mounted at a lower face of said top (100), in a hidden and retracted position with respect to the visible edge (101) and at a distance from the visible edge (101) substantially equal to the distance between the drawer in the extracted position and the space occupied by the drawer (10) in the retracted position.

8 Claims, 4 Drawing Sheets

EXTRACTABLE DRAWER DEVICE AND FURNITURE ITEM COMPRISING SAID DRAWER DEVICE

CROSS-REFERENCE TO RELATED APPLICATION

This application claims priority to, and the benefit of, Italian Application No. MI2013A001990, filed Nov. 28, 2013, which is herein incorporated by reference in its entirety.

SCOPE OF THE INVENTION

The present invention relates to an extractable drawer device associable with a furniture item in particular having a shelf, for example a support surface. The present invention also relates to an a furniture item or furnishing element, in particular a table, comprising such extractable drawer device.

STATE OF THE ART

The technique of mounting a sliding drawer in the frame of a piece of furniture, such as a table so that the drawer can slide along a lower face of a support surface of the table between a closed position in which access to the inside of the drawer is prevented and an open position in which access to the inside of the drawer is allowed through the top opening of the drawer, is known of in the art.

A drawer is in general a container having two side walls generally parallel to each other, a rear wall facing the inside of the piece of furniture or table and a front wall facing the outside of the furniture item or table.

The front and rear walls connect the side walls to each other, forming a containment compartment together with a bottom wall which extends transversely to the side, front and rear walls. Such containment compartment is open at the top by means of an upper opening.

According to the prior art, in order to facilitate the manual operation of the drawer, it is placed with respect to the furniture item in a position such that when the drawer is in the closed or retracted position, a front portion of the drawer, for example the front wall, or a grip handle thereof, can be easily reached manually by a user and is also clearly visible to said user.

To meet these requirements, the drawer is generally mounted so that when it is in the closed or retracted position, it presents its front portion, for example, a grip portion or handle, as close as possible to an outer face of the frame of the furniture item or table, typically substantially vertical, which a possible user who intends to manually operate the drawer can face directly.

In particular, to satisfy the aforementioned requirements, the drawer of the prior art is preferably arranged so that its front wall is flush with the front face of the piece of furniture when the drawer is closed.

In the case in which the sliding drawer is mounted in a table, or to a lower face of a table top, to meet said requirements it is mounted so that when closed, its front wall is aligned with a visible outer edge of the table top.

However, in such closed or retracted position, with the front wall aligned with the edge of the table, the drawer occupies space below the table top, which takes from the space available for the user's legs when the user is sitting at the table. In this case, to increase the space for the user's legs under the table the table top would need to be raised, but this would detract from the ease of use of the table, forcing the user to adopt an incorrect posture.

Aside from the aforesaid disadvantages of use of a drawer associated with a table according to the prior art, in addition, the presence of the drawer with its front wall aligned or in correspondence with the visible front edge of the table top, also produces an anti-aesthetic effect in that an increase in the thickness of the table top can be seen, giving an idea of heaviness and bulkiness, which is counter to the requirements of lightness and linearity of furniture and furnishings in a minimalist style, highly sought after and desired.

SUMMARY OF THE INVENTION

The purpose of the present invention is to excogitate and provide an extractable drawer device associated with a shelf of a furniture item, for example a support surface of a table, which makes it possible to satisfy the above needs and at least partially overcome the drawbacks mentioned above with reference to the prior art.

In particular, one purpose of the present invention is to provide an extractable drawer device associable with a shelf of a furniture element, which, when the drawer is in the retracted or closed position can be concealed from view, and hidden by the shelf from a user sitting in front of the piece of furniture or at the table.

A further purpose of the invention is to provide an extractable drawer device associated with a shelf of a furniture item, for example a table, able to avoid occupying space under the table top in the proximity of one of its visible front edges which may face a user, when the drawer is in a retracted position, thus leaving free the space below the table for a comfortable positioning of the user's legs when sitting at the table.

It is thus a purpose of the invention to provide an extractable drawer device associated with a table top, which avoids occupying space intended to be occupied by the user's legs when said user is sitting at the table.

These and further purposes and advantages are achieved by means of an extractable drawer device associated with a shelf of a furniture element, according to claim 1.

According to another aspect of the invention, these and further purposes and advantages are achieved by a furniture item comprising such drawer device.

The extractable drawer device according to the invention comprises a drawer 10 having a front end 15 and a rear end 14 with respect to an extraction direction of the drawer in a sliding direction S-S; a guide and support system of the drawer 10 connectable to a furniture item and configured to allow a displacement of the drawer 10 between a retracted drawer position and an extracted drawer position, wherein, in the extracted drawer position, the drawer 10 is completely outside and distanced from the space it occupies in the retracted position.

These features solve the aforementioned technical problem.

In fact, the provision of allowing the drawer to move backwards under the shelf, away from the edge of the shelf, makes it possible to place said drawer in a position in which it is completely hidden from view by a user who usually has a point of view which is higher from the ground than the height of the shelf from the ground. This way the drawer, in the rearward position is concealed from the user even if the user is sitting.

This provision thus makes it possible to keep the drawer away from prying eyes.

Moreover, when the drawer is in the rearward or retracted position, it leaves free space under the table near the edge 101 of the table top, thus leaving space free for the user's legs, thereby preventing the user from accidentally hitting the drawer.

Furthermore, the provision of being able to distance the drawer from the edge of the shelf towards the inside of the shelf, makes it possible to provide the furniture item with an aesthetic appearance of linearity and lightness since, in the retracted position of the drawer, only the edge 101 of the shelf of the furniture item is visible, which appears with its thickness only, the thickness of the drawer not being visible.

Advantageously the guide and support system comprises a stationary guide portion 40 extending along said sliding direction S-S, and a mobile guide portion 30 supporting the drawer 10 and connected to the stationary guide portion 40 so as to slide in the sliding direction S-S between: a rear end-stroke position corresponding to said retracted drawer position, and a front end-stroke position corresponding to said extracted drawer position.

Advantageously, the extractable drawer device may comprise a locking mechanism for locking/releasing the sliding of the mobile guide portion with respect to the stationary guide portion, comprising a closure member configured to be operable between a release position, in which said closure member allows the sliding of the mobile guide portion with respect to the stationary guide portion between the front end-stroke position and the rear end-stroke position, and vice versa; and a locking position, in which said closure member prevents the sliding of the mobile guide portion with respect to the stationary guide portion from an intermediate position of the mobile guide portion, in which the drawer is partially outside the stationary guide portion, at the front end-stroke position of the mobile guide portion.

This provision makes it possible to close the drawer by means of a lock, conveniently and safely so as to avoid compromising the secretion of the drawer under the table, and without compromising the convenience of use thereof.

In addition, such provision makes it possible to close the aforesaid drawer with a lock avoiding obliging the user to bend under the table to reach such lock.

BRIEF DESCRIPTION OF THE DRAWINGS

Various embodiments of the invention will be described below by means of embodiments made by way of non-limiting examples, with particular reference to the appended drawings, wherein.

DESCRIPTION OF SOME PREFERRED EMBODIMENTS

Figure 1:
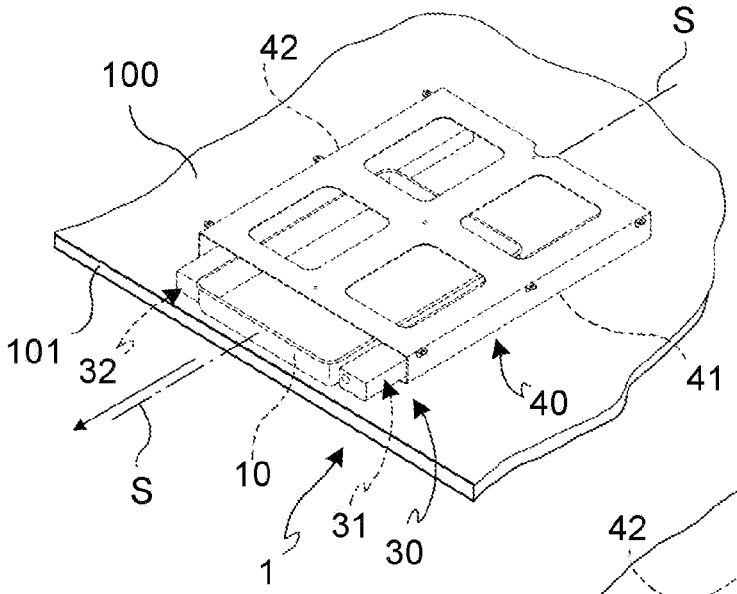
FIGS. 1 to 3 show perspective views, respectively of three different positions of the drawer in its sliding path between a partially retracted position and a fully open position of the drawer.

Reference will be made below to "sliding direction" (S-S) to indicate a direction of movement of the drawer between a retracted position and an extracted position thereof. It coincides with the direction of movement between a mobile guide portion which the drawer is associated with, and a stationary guide portion attached to a fixed element, for example to a table top.

Along the sliding direction an "extraction" direction of the drawer can be defined from the retracted position to the extracted position of the drawer, and a "return" direction from the extracted position to the retracted position.

The wall or end of the drawer facing in the direction of extraction is defined as the "front" wall or "front" end or "front" side, and that facing the opposite or return direction is defined as the "rear" wall or "rear" end or "rear" side.

Similarly, the "front" end-stroke means the final position of the mobile guide portion with respect to the stationary guide portion in the direction of extraction, while the "rear" end-stroke refers to the opposite final position of the mobile guide portion with respect to the stationary guide portion in the opposite or "return" direction.

In addition, "longitudinal direction" means a direction parallel to the sliding direction of the drawer with respect to the top, or to the sliding direction of the mobile guide portion with respect to the stationary guide portion.

"Transversal direction" indicates a direction transversal to the sliding direction, in particular substantially parallel to the table top or furniture item to which the extractable drawer device is or can be attached.

With reference to the figures, an extractable drawer device according to the invention is globally identified by reference numeral 1.

The extractable drawer device 1 comprises a drawer that can be arranged so as to be able to slide parallel to a shelf 100 of a furniture item, for example of a table top of a table, in a sliding direction S-S. For example, the shelf 100 of the piece of furniture is delimited at least partially by a visible edge 101.

The extractable drawer device 1 is or can be attached to the shelf 100 so as to slide in the sliding direction S-S in a transversal direction to a visible edge portion 101 of the shelf, which a user may operatively face. The shelf 100 is preferably arranged in a substantially horizontal position. In this case the shelf 100 is a support surface, such as a table top of a table.

The extractable drawer device 1 can be attached to a lower face of the shelf 100 of the furniture item, for example of the support surface.

Drawer is taken to mean a box-shaped container with an upper opening 16, defined for example by a closed contour for access to an inner containment compartment thereof, defined at least by a bottom wall 11 and by the containment walls 12, 13, 14, 15 which rise from the edges of the bottom wall 10 transversely to the bottom wall to define said inner containment compartment. For example, the containment walls comprise two opposite side walls 12 and 13 substantially parallel to each other and parallel to the sliding direction S-S. For example, the containment walls include a front wall 15 substantially orthogonal to the sliding direction S-S and facing towards the outside of the shelf 100, or support surface for example in the direction of extraction of the drawer, for example parallel to a portion of the visible edge 101 of the shelf 100. The containment walls may include a rear wall 14 opposite the front wall 15, facing in the return direction of the drawer.

The drawer, in particular, is arranged with the opening 16 facing the shelf 100, so that depending on the position of the drawer with respect to the shelf 100 such opening 16 may be occluded or left open by said shelf 100.

According to one embodiment, the drawer 10 is a tray, for example, with the containment walls 12, 13, 14, 15 having a dimension measured transversely to the bottom 10, or height, much smaller than the greatest dimension of said bottom 11. In other words, the tray is a drawer with short containment walls.

Such a kind of drawer, or tray is particularly suitable to contain documents or objects of reduced height.

The drawer 10, or the tray, can be made in one piece, for example in sheet metal or plastic and comprises an upper opening terminating in rounded edges or bent edges for example outwardly.

The extractable drawer device 1 comprises a guide and support system of the drawer 10 connectable to a piece of furniture and configured to allow a displacement of the drawer 10 between a retracted drawer position and an extracted drawer position, wherein, in the extracted drawer position, the drawer 10 is completely outside and distanced from the space it occupies in the retracted position.

For example, in said extracted position the drawer 10 is distanced from the space that it occupies in the retracted position, for example by a predetermined distance D.

According to one embodiment, the guide and support system comprises:

a stationary guide portion 40 extending along said sliding direction S-S;

a mobile guide portion 30 supporting the drawer 10 and slidably connected to the stationary guide portion 40 along the sliding direction S-S between: a rear end-stroke position corresponding to said retracted drawer position, and a front end-stroke position corresponding to said extracted drawer position.

The mobile guide portion 30, is attached or can be attached to the drawer 10, to allow the sliding of the drawer 10 in a sliding direction S-S.

According to one embodiment, the drawer 10 or the tray is removable and separable from the mobile guide portion 30, so that it can be easily replaced. This solution is particularly advantageous in the case in which one wishes to adapt the appearance of the drawer device, or furniture item to the preferences of the interior designer or to the external environment.

Furthermore, the fact that the drawer or tray is separable from the mobile guide portion 30 simplifies cleaning operations.

In other words, the mobile guide portion 30 may comprise a housing or support portion to contain or support the drawer or tray in a removable manner.

Alternatively, the drawer or tray is fixed in a non-removable manner to the mobile guide portion 30.

The stationary guide portion 40 is attached to the shelf 100, to slidingly engage the mobile guide portion 30 to allow the sliding of the mobile guide portion 30 relative to the stationary guide portion 40 in the sliding direction S-S between the closed or retracted position, of the drawer 10 in which access is prevented to the inside of the drawer 10 and an open or extracted position of the tray 10 in which access is permitted to the inside of the drawer 10.

The stationary guide portion 40 has its front end 47 positioned in the direction of extraction in the sliding direction S-S.

Figure 2:
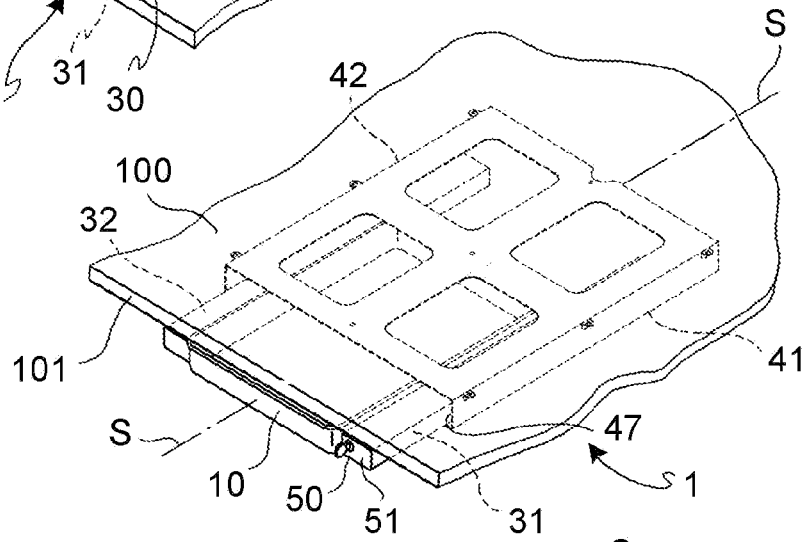
Figure 5:
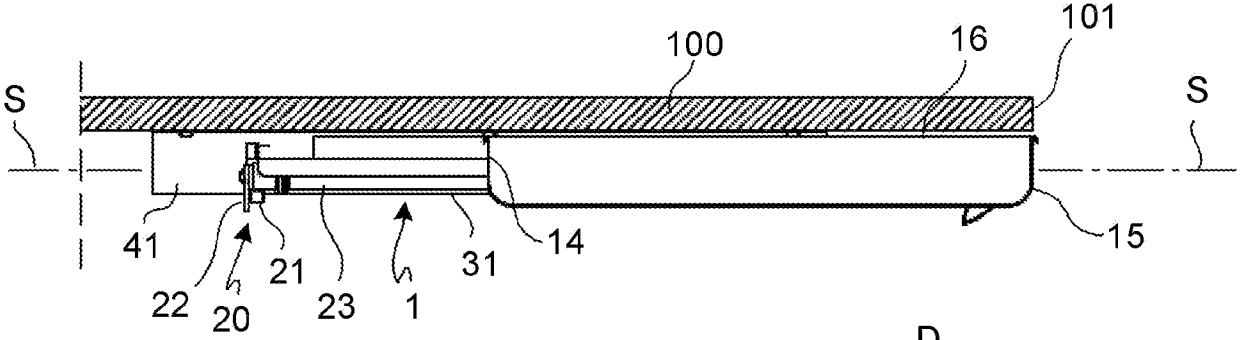

A closed position of the drawer or retracted position of the drawer is taken to mean a position in which the opening 16 of the drawer 10 is completely occluded by the shelf 100. In this situation the opening 16 is completely facing a face of the support surface, preferably the lower face of the support surface. Such a situation is shown in FIG. 2 and FIG. 5.

The extracted position of the drawer 10 is, instead, when the drawer is in the extracted position with respect to the fixed guide portion or to the support surface 100, in which the drawer is outside the space it occupies when it is in the retracted position, and the opening 16 of the drawer is free from the support surface allowing access to the inside of the drawer.

According to one embodiment, the extracted position of the drawer 10 corresponds to a position thereof in which the opening 16 of the drawer is completely outside the visible edge 101 of the shelf 100, so that the opening 16 is completely free for access to the inside of the drawer through said opening.

Figure 3:
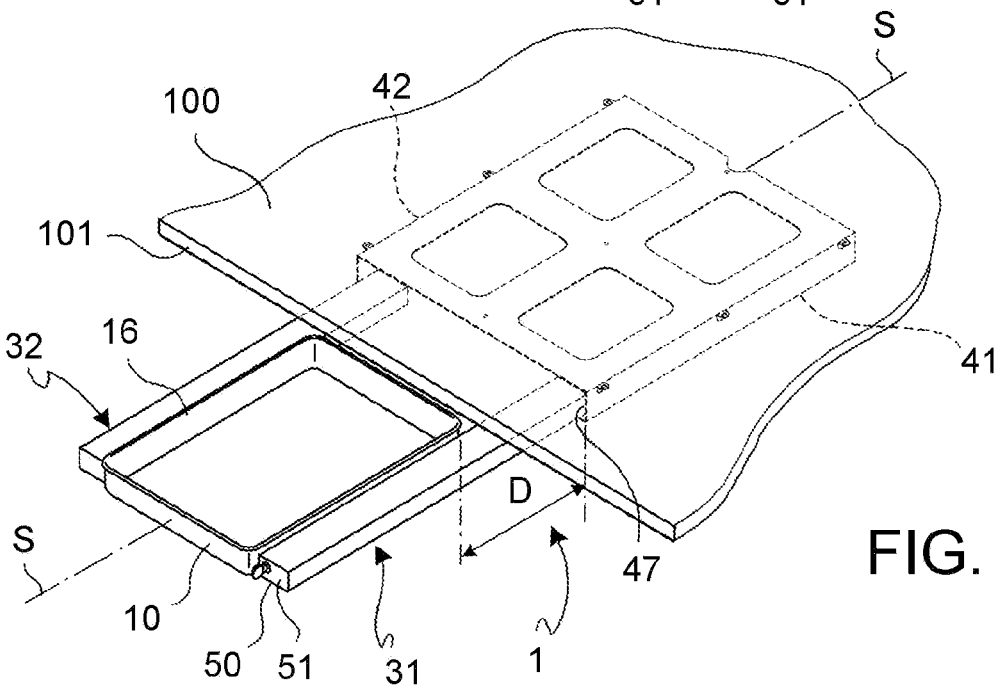
Figure 4:
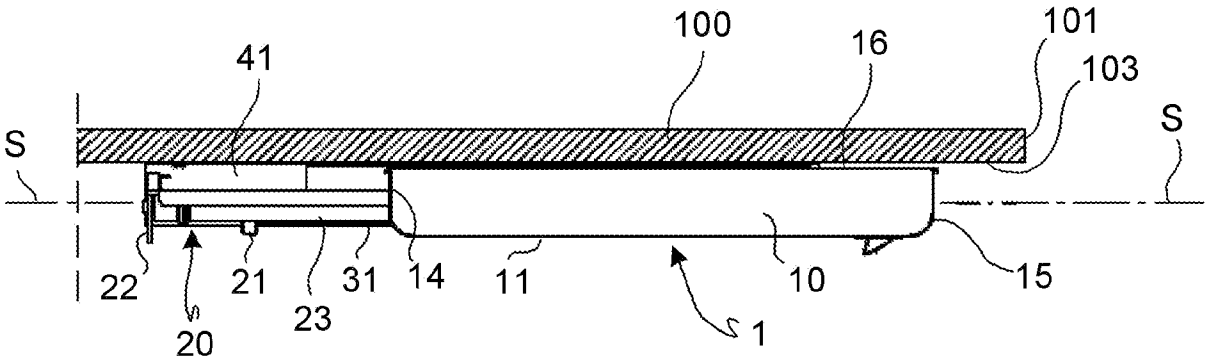
FIGS. 4 to 6 show a longitudinal cross-section by a cross-section plane along a sliding direction orthogonal to the table top, respectively in the three positions of FIGS. 1, 2, 3.
Figure 6:
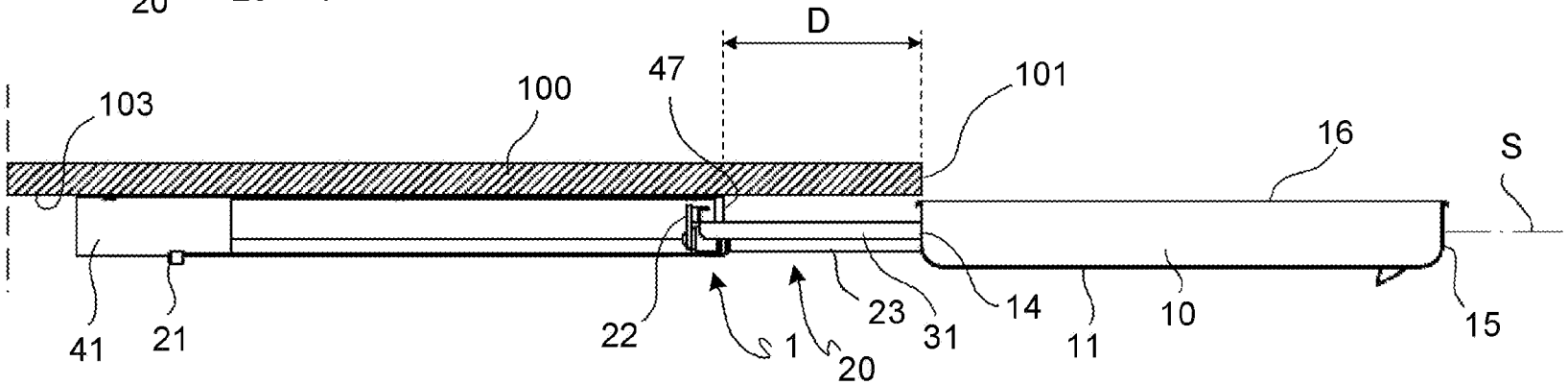
Figure 7:
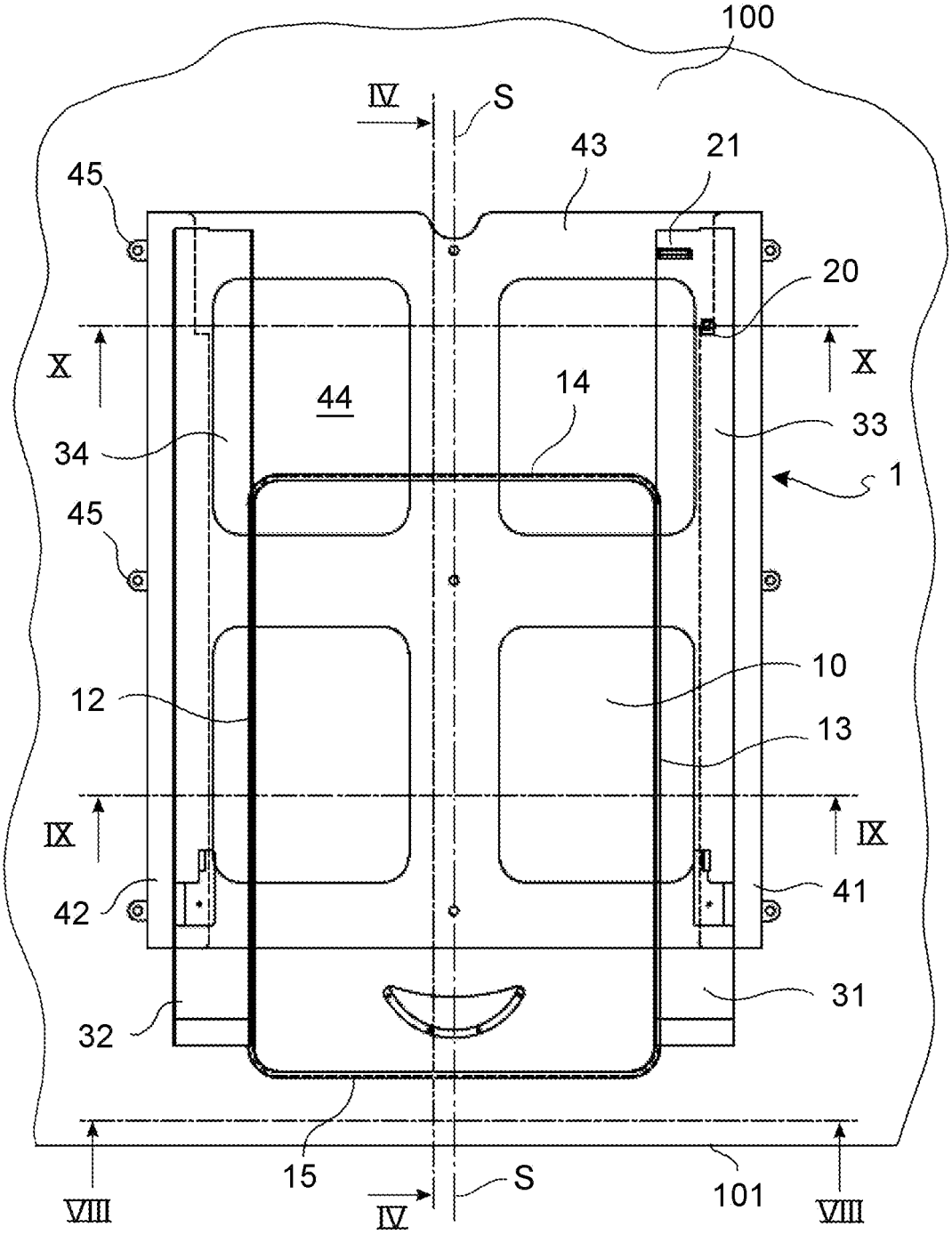
FIG. 7 shows a view from above of an extractable drawer device according to the invention in the position of FIG. 1.
Figure 8:
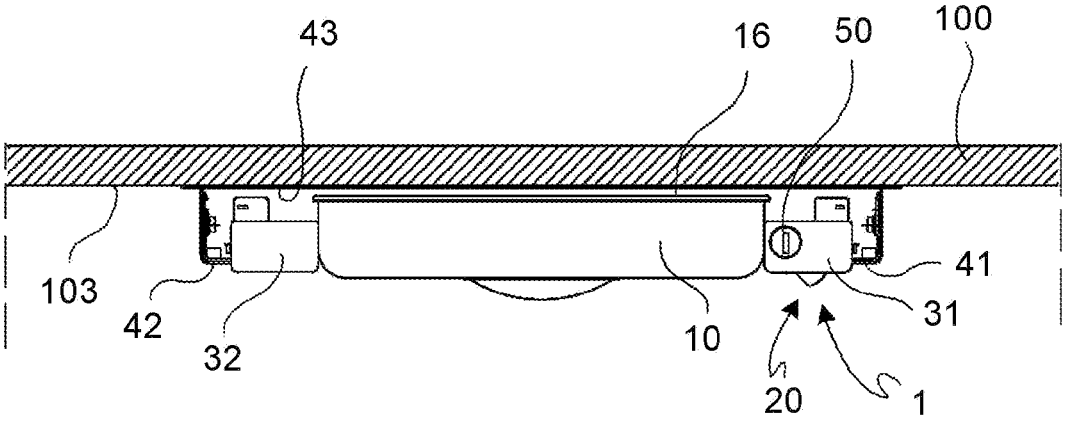
FIGS. 8, 9 and 10 show three transversal cross-sections of the drawer device in FIG. 7, respectively by the cross-section planes X, IX, VIII.
Figure 9:
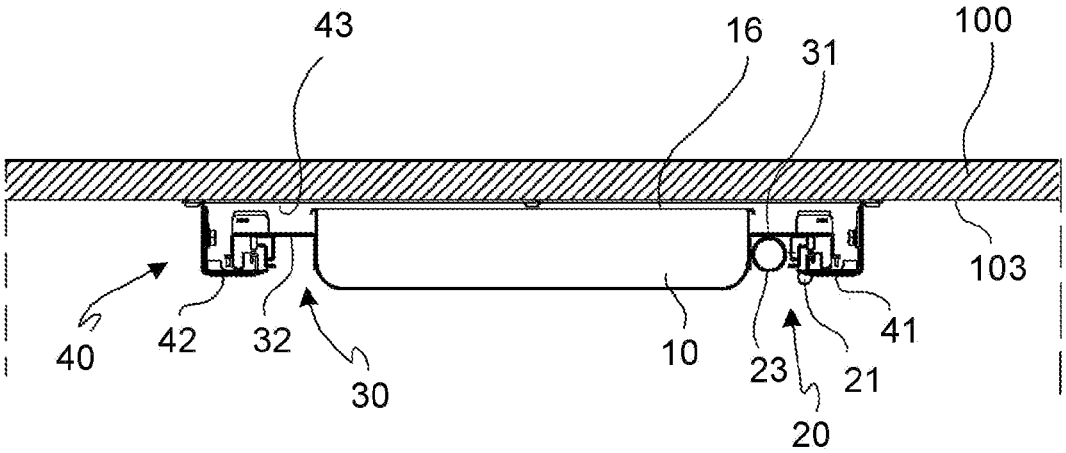
Figure 10:
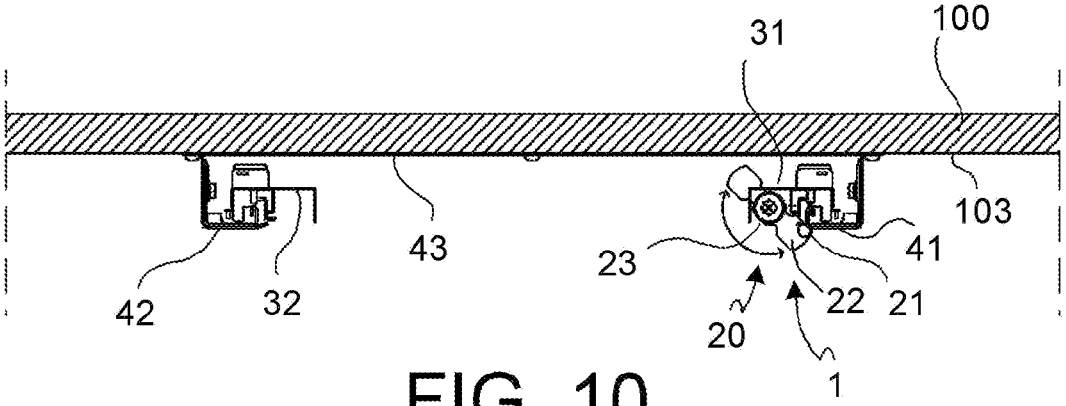

Preferably, in the extracted position, the rear wall 14 of the drawer 10 is aligned with the visible edge 101 of the shelf. This situation is clearly visible in FIGS. 3 and 6.

In other words, the mobile guide portion 30 can slide with respect to the stationary guide portion 40 between a rear end-stroke position corresponding to a closed drawer position, and a front end-stroke position corresponding to a drawer open position.

In this front end-stroke position the mobile guide 30 projects forwards from the stationary guide portion 40, so as to bring the drawer completely outside the stationary guide portion 40 and so that the rear end 14, or the rear wall of the drawer 10 is outside the stationary guide portion 40, for example at a predetermined distance D from said front end 47 of the stationary guide portion in the sliding direction S-S.

In the rear end-stroke position the mobile guide portion 30 is positioned so as to bring the drawer 10 into a retracted position with its front end 15 near the front end 47 of the stationary guide portion 40.

The provision according to which, in the front end-stroke position, the rear wall 14 of the drawer 10 is positioned outside the stationary guide portion 40 at a predetermined distance D from the front end 47 of the guide in the sliding direction S-S, is extremely advantageous.

In other words, according to one embodiment, the stationary guide portion 40 is attached to the support surface, in particular to its lower face, at the predetermined distance D from the visible edge 101. More specifically, the stationary guide portion 40 is attached to the support surface 100, in particular to its lower face, so that the front end 47 of the stationary guide portion is distanced from the visible edge 101 of the shelf 100 according to the predetermined distance D.

This makes it possible to conceal the drawer device 1 from view, for example under the top, in the rearward position, at a distance D from the visible edge 101 of the shelf, thereby distancing the drawer 10 from the visible edge 101.

This way it is possible to push the drawer into a rearward position with respect to the edge of the table.

The rearward position of the drawer is taken to mean a position in which the drawer is at the rear end-stroke of its sliding path, in the farthest position from the edge of the shelf.

In other words, the extractable drawer device 1 according to the invention is designed to allow an extra-stroke of the drawer rearwards in the direction opposite to that of extraction of the drawer, for example, away from the visible edge 101, as far as the rear end-stroke, in which the drawer is in the retracted or closed position, for example in which the front wall 15 of the drawer moves rearwards from the visible edge 101 of the support surface, for example at a distance equal to D.

The support surface 100, for example a table top of a table, is preferably positioned in a substantially horizontal position, and the extractable drawer device is preferably attached to a lower face of said support surface.

According to one embodiment, the stationary guide portion 40 comprises at least one elongated portion 41, 42 substantially parallel to the sliding direction S-S positioned laterally to the drawer 10, and at least a mobile guide portion 30 comprising a corresponding carriage portion 31, 32 slidingly connected to the at least one guide portion 41, 42 in the sliding direction.

According to one embodiment, the two carriage portion 31, 32 comprises a respective rear extension 33, 34 which extends beyond the drawer rearwards with respect to a direction of extraction of the drawer 10, by a length measured in the sliding direction S-S greater than the predetermined distance D.

According to one embodiment, the guide 40 comprises two elongated portions 41 and 42 parallel to each other and to the sliding direction S-S, positioned laterally on opposite sides of the drawer 10.

According to one embodiment, the mobile guide portion 30 comprises two corresponding carriage portions 31, 32 positioned on opposite sides of the drawer 10, in particular attached to the drawer 10, each of said carriage portions 31, 32 being slidingly coupled to one of said elongated portions 41, 42 in the sliding direction S-S.

In other words, according to one embodiment, the stationary guide portion 40 comprises two elongated portions 41 and 42 parallel to each other and to the sliding direction S-S, positioned laterally on opposite sides of the drawer 10, and the mobile guide portion 30 comprises two corresponding carriage portions 31, 32 positioned on opposite sides of the drawer 10, each of said carriage portions 31, 32 being slidingly coupled to one of said guide portions 41, 42 in the sliding direction S-S, wherein each of said carriage portions 31, 32 comprises a respective rear extension 33, 34 which extends beyond the drawer rearwards with respect to a direction of extraction of the drawer 10, of a length measured in the sliding direction S-S greater than the distance between the drawer 10 in the extracted position and the drawer 10 in the retracted position.

According to one embodiment, said carriage portion 31, 32, or portions 31, 32 is or are made of a box-like structure which extends along a straight axis, in particular parallel to the sliding axis S-S.

For example, said carriage portions 31, 32 have a "C" cross-section, for example with the ends facing downwards, of which a first end faces a side wall 12, 13 of the drawer 10 and the other end faces away.

The two ends of the "C" cross-section are connected to each other by a flat connection portion, for example substantially orthogonal to the end portions.

According to one embodiment, the flat connection portions of the two carriage portions 31 and 32 are coplanar with each other, for example according to a plane substantially parallel to the support surface 100.

According to one embodiment, the two carriage portions 31 and 32 are connected to each other only by the drawer 10 positioned between them, avoiding other connecting elements.

In an alternative embodiment, the carriage portions 31 and 32 are connected to each other by a connecting portion, not shown in the figures.

In such case, the carriage portions 31 and 32, together with the connecting portion, form a recess for removably housing the drawer 10, or tray.

According to one embodiment, the stationary guide portion 40 comprises a connecting portion 43 which rigidly connects the elongated portions 41, 42 to each other forming a substantially "C" shaped overall structure of which the ends are formed by the elongated portions 41, 42 and the central part is formed by the connecting portion 43, said stationary guide portion 40 embracing the mobile guide portion from the outside in a suspended manner.

According to one embodiment, the connecting portion 43 is a flat plate.

According to one embodiment, the connecting portion 43 and the elongated portions 41 and 42 are made in one piece from a single sheet, for example by bending.

According to one embodiment, the central portion 43 may comprise lightening cavities 44.

According to one embodiment, the central portion 43 comprises holes for attaching the guide 40 to the support surface, for example of the furniture item or table, for example to the lower face of the support surface 100.

According to one embodiment, the stationary guide portion 40 comprises attachment grommets 45 for attaching to the shelf 100, which extend laterally outwardly of the stationary guide portion 40.

According to one embodiment, each of said carriage portions 31, 32 comprises a respective rear extension 33, 34 which extends beyond the drawer rearwards with respect to a direction of extraction of the drawer 10, of a length measured in the sliding direction S-S greater than the distance between the drawer in the extracted position and the drawer in the retracted position.

For example each of said carriage portions 31, 32 comprises a respective rear extension 33, 34 which extends beyond the drawer rearwards with respect to a direction of extraction of the drawer 10, by a length measured in the sliding direction S-S greater than the predetermined distance D.

According to one embodiment, the drawer device 1 comprises a locking mechanism 20 for locking/releasing the sliding of the mobile guide portion 30 with respect to the stationary guide portion 40, comprising a closure member 22 configured to be operable between a release position and a locking position.

In the aforesaid locking position said closure member 22 allows the sliding of the mobile guide portion with respect to the stationary guide portion 40 between the front end-stroke position and the rear end-stroke position, and vice versa.

In the locking position said closure member 22 prevents the mobile guide portion 30 from sliding with respect to the stationary guide portion 40 from an intermediate position of the mobile guide portion 30, in which the drawer is partially outside the stationary guide portion 40, to the front end-stroke position of the mobile guide portion 30.

The intermediate position of the mobile guide portion 30, or of the drawer 10, corresponds to the position of the mobile guide portion 30, or of the drawer 10, in which the front wall 15 of the drawer 10 is positioned at a distance from the front end 47 of the stationary guide portion 40, substantially equal to the predetermined distance D.

In other words, said intermediate position of the mobile guide portion 30, or of the drawer 10, corresponds to a position of the mobile guide portion 30, or of the drawer 10, in which the front end 15, or front wall, or front side of the drawer is substantially aligned with the visible edge 101 of the support surface or of the table. Said position is shown in FIG. 2 and FIG. 5.

In said intermediate position, access to the inside of the drawer is prevented.

In said intermediate position, access is also permitted to the locking mechanism 20 by a user, who in this intermediate position can easily operate it to move it between the locking position and the release position and vice versa.

According to one embodiment, the extractable drawer device comprises a unilateral stop 21 suitable to act as a constraint in the sliding direction S-S, in particular in the direction of extraction, and wherein the closure member 22 in the locking position, projects in a transversal direction to the sliding direction S-S and is suitable to abut against said unilateral stop 21 so as to prevent the mobile guide portion 30 from sliding between the intermediate position and the front end-stroke position, and at the same time allow the mobile guide portion 30 to freely slide between the intermediate position and the rear end-stroke position.

This provision gives the undeniable advantage of being able to conveniently operate the closure mechanism as well as to conceal the drawer by pushing it into a retracted position under the table.

According to one embodiment, the locking mechanism is mounted on the mobile guide portion 30 and the unilateral stop 21 is attached to the stationary guide portion 40.

According to one embodiment, the locking mechanism 20 is contained inside the mobile guide portion 30, in particular inside one of the carriage portions 31 or 32.

According to one embodiment, the locking mechanism comprises a shaft 23 rotatable around its axis, positioned parallel to the sliding direction S-S and laterally to the drawer 10.

According to one embodiment, the closure element 22 is attached transversely to the shaft 23 so as to project, so that by rotating the shaft 23 between a first angular position and a second angular position, the closure element 22 is moved between the locking position and the release position.

According to one embodiment, the drawer device 1 comprises a lock 50 to actuate the closure mechanism 20, wherein said lock is mounted on the mobile guide portion 30 in a position facing forwards in an extraction direction of the drawer 10.

According to one embodiment the lock 50 is positioned substantially aligned with the front end 15, or front wall of the drawer 10.

According to one embodiment, the mobile guide portion 30 ends at the front with a plate 51 transversal to the sliding direction, for example, positioned substantially aligned with the front wall 15 of the drawer, in particular such plate is positioned so as to close the carriage portion 31 containing the locking mechanism 20.

According to one embodiment, the lock 50 is mounted on said plate 51.

According to one embodiment, the lock 50 is aligned with the shaft 23.

The functioning of the drawer device described above from a structural point of view will now be described.

Starting from the rear end-stroke position, to access the inside of the drawer when the locking mechanism is in the locking position it is sufficient to perform the following steps:

pull the drawer, for example manually, from the rear end-stroke position back to the intermediate position, in which access to the inside of the drawer is not yet allowed;

in this intermediate position operate the locking mechanism 20, for example, using the lock 50, which, in said position, is substantially aligned with, or next to the visible edge 101 of the top 100, so as to move the closure element 22 from the locking position to the release position and to release the drawer outwardly;

continue to pull the drawer in the direction of extraction as far as the front end-stroke, allowing access to the inside of the drawer.

To replace the drawer or tray in the concealed and closed position corresponding to the rear end-stroke instead, starting from the extracted position, thus from the front end-stroke, simply perform the following steps:

push the drawer from the front end-stroke to the intermediate position, in which the lock is positioned near to or aligned with the visible edge 101 of the shelf 100, and can therefore be easily operated;

actuate the locking mechanism 20 using the lock, to move the locking element 22 from the release position to the locking position;

continue to push the drawer as far as the rear end-stroke position.

According to another aspect, the invention relates to a furniture item having a shelf 100 having a visible edge 101, in particular a table having a table top, comprising an extractable drawer device 1 as described above.

Said drawer device 1 is mounted on a lower face of said shelf 100, in a position hidden and rearward of the visible edge 101 and at a distance from the visible edge 101 substantially equal to the distance between the drawer in the extracted position and the space which the drawer 10 occupies in the retracted position.

The shelf 100 is for example a support surface of a table, for example suitable to be positioned in a substantially horizontal position, at least partially defined by a visible edge 101.

The drawer 10 has an inner space open from above and defined by an opening 16 facing the shelf 100, and a front side 15 facing towards the outside of the top in the sliding direction S-S of the drawer 10 parallel to the shelf 100, in a direction substantially transversal to the edge 101.

The guide 40 is attached to a lower face 103 of the support surface 100 supporting, for example in a suspended manner, the mobile guide portion 30, so that the sliding direction S-S is substantially transversal to the visible edge 101 of the top 100 and substantially parallel to the support surface 100.

The guide 40 is attached to the lower face 103 of the support surface 100 so that the front end 47 of the stationary guide portion 40 is positioned at a distance from the edge 101 of the support surface, substantially equal to the predetermined distance D.

In addition to these advantages, the present invention makes it possible to simultaneously solve the conflicting requirements outlined above, i.e. to provide a sliding drawer device and a furniture item having such a drawer device, able to store the drawer in a hidden position away from the edge of the table, close it with a lock, also hidden, and at the same time allow the lock to be to easily and conveniently operated.

A person skilled in the art may make modifications and adaptations to the embodiments of the device described above, replacing elements with others functionally equivalent so as to satisfy contingent requirements while remaining within the sphere of protection of the following claims. Each of the characteristics described as belonging to a possible embodiment may be realised independently of the other embodiments described.

The invention claimed is:

1. An extractable drawer device (1), comprising:

a drawer (10) having a front end (15) and a rear end (14) with respect to an extraction direction of the drawer in a sliding direction (S-S);

a guide and support system of the drawer (10) connectable to a furniture item and configured to allow a displacement of the drawer (10) between a retracted drawer position and an extracted drawer position, wherein, in the extracted drawer position, the drawer (10) is completely outside and distant from the space it occupies in the retracted position, wherein the guide and support system comprises:

a stationary guide portion (40) extending along said sliding direction (S-S);

a mobile guide portion (30) supporting the drawer (10) and slidably connected to the stationary guide portion (40) along the sliding direction (S-S) between: a rear end-of-stroke position corresponding to said retracted drawer position, and a front end-of-stroke position corresponding to said extracted drawer position;

a closure mechanism (20) to lock/release the sliding of the mobile guide portion (30) with respect to the stationary guide portion (40), comprising a closure member (22) configured to be operated between:

a release position, in which said closure member (22) allows the sliding of the mobile guide portion (30) with respect to the stationary guide portion (40) between the front end-of-stroke position and the rear end-of-stroke position, and vice versa; and a locking position, in which said closure member (22) prevents the mobile guide portion (30) from sliding with respect to the stationary guide portion (40) from an intermediate position of the mobile guide portion (30), in which the drawer is partially outside the stationary guide portion (40), to the front end-of-stroke position of the mobile guide portion (30).

2. The extractable drawer device according to claim 1, wherein, in said front end-of-stroke position, the mobile guide portion (30) projects from the stationary guide portion (40) in an extraction direction, so that the drawer (10) is completely outside the stationary guide portion (40) and that the rear end (14) of the drawer (10) is at a preset distance value (D) from a front end (47) of the stationary guide portion (40) along the sliding direction (S-S).

3. The extractable drawer device according to claim 1, wherein said stationary guide portion (40) comprises at least one elongated portion (41, 42) substantially parallel to the sliding direction (S-S) arranged laterally to the drawer (10), and the mobile guide portion (30) comprises at least one corresponding carriage portion (31, 32) slidably connected to the at least one elongated portion (41, 42) in the sliding direction, wherein said at least one carriage portion (31, 32) comprises a respective rear extension (33, 34) extending past the drawer rearwards with respect to an extraction direction of the drawer (10), having a length as measured in the sliding direction (S-S) that is greater than the distance value between the drawer (10) in the extracted position and the drawer (10) in the retracted position.

4. The extractable drawer device according to claim 1, wherein said closure member (22) is configured so that, in said locking position, it allows sliding of the mobile guide portion (30) between said intermediate position of the mobile guide portion (30) and said rear end-of-stroke position.

5. The extractable drawer device according to claim 4, comprising a unilateral stop (21) acting as a constraint in the sliding direction (S-S), and wherein the closure member (22) is configured, when it is in the locking position, to project in the transversal direction with respect to the sliding direction (S-S) and to abut against said unilateral stop (21) preventing the mobile guide portion (30) from sliding between the intermediate position and the front end-of-stroke position, and allowing the mobile guide portion (30) to freely slide between the intermediate position and the rear end-of-stroke position.

6. The extractable drawer device (1) according to claim 1, wherein the closure mechanism (20) comprises a shaft (23) that may rotate about its axis, which is arranged parallel to the sliding direction (S-S) and laterally to the drawer (10), and the closure member (22) is transversally secured to the shaft (23) in a projecting manner, so that by rotating the shaft (23) between a first angular position and a second angular position, the closure member (22) is displaced between said locking position and said release position.

7. The extractable drawer device according to claim 6, comprising a lock (50) to actuate the closure mechanism (20), said lock (50) being mounted at said mobile guide portion (30) in a position facing forwards in an extraction direction of the drawer (10).

8. A furniture item with a shelf (100) having a visible edge (101), in particular a table, comprising:

An extractable drawer device (1), comprising:

a drawer (10) having a front end (15) and a rear end (14) with respect to an extraction direction of the drawer in a sliding direction (S-S);

a guide and support system of the drawer (10) connectable to a furniture item and configured to allow a displacement of the drawer (10) between a retracted drawer position and an extracted drawer position, wherein, in the extracted drawer position, the drawer (10) is completely outside and distant from the space it occupies in the retracted position, wherein the guide and support system comprises:

a stationary guide portion (40) extending along said sliding direction (S-S);

a mobile guide portion (30) supporting the drawer (10) and slidably connected to the stationary guide portion (40) along the sliding direction (S-S) between: a rear end-of-stroke position corresponding to said retracted drawer position, and a front end-of-stroke position corresponding to said extracted drawer position;

a closure mechanism (20) to lock/release the sliding of the mobile guide portion (30) with respect to the stationary guide portion (40), comprising a closure member (22) configured to be operated between:

a release position, in which said closure member (22) allows the sliding of the mobile guide portion (30) with respect to the stationary guide portion (40) between the front end-of-stroke position and the rear end-of-stroke position, and vice versa; and a locking position, in which said closure member (22) prevents the mobile guide portion (30) from sliding with respect to the stationary guide portion (40) from an intermediate position of the mobile guide portion (30), in which the drawer is partially outside the stationary guide portion (40), to the front end-of-stroke position of the mobile guide portion (30), wherein:

said drawer device (1) is mounted at a lower face of said shelf (100), in a position that is hidden and retracted with respect to the visible edge (101) and at a distance from the visible edge (101) substantially equal to the distance between the drawer in the extracted position and the space occupied by the drawer (10) in the retracted position.

* * * * *